United States Patent [19]

Haber

[11] 4,023,347

[45] May 17, 1977

[54] WRISTWATCH CASING AND BAND CONSTRUCTION

[76] Inventor: Terry M. Haber, 3050 S. Bristol, No. 8C, Santa Ana, Calif. 92707

[22] Filed: Oct. 17, 1975

[21] Appl. No.: 623,352

[52] U.S. Cl. ..... 58/88 R; 58/23 BA

[51] Int. Cl.[2] ..... G04B 37/00

[58] Field of Search ..... 58/50 R, 88 R, 88 SC, 58/88 G, 23 BA, 23 R

[56] References Cited

UNITED STATES PATENTS

| | | | |
|---|---|---|---|
| 2,472,351 | 6/1949 | Tyler | 58/88 R |
| 3,492,809 | 2/1970 | Gisiger-Lusd | 58/88 R |
| 3,729,923 | 5/1973 | Brigliano et al. | 58/23 BA |
| 3,838,568 | 10/1974 | Zurcher | 58/50 R |
| 3,911,666 | 10/1975 | Haber | 58/50 R |
| 3,924,400 | 12/1975 | Carlone | 58/50 R |

FOREIGN PATENTS OR APPLICATIONS

| | | | |
|---|---|---|---|
| 1,552,270 | 11/1968 | France | 58/88 R |

*Primary Examiner*—Robert K. Schaefer

*Assistant Examiner*—Vit W. Miska

*Attorney, Agent, or Firm*—Ralph B. Pastoriza

[57] ABSTRACT

A combined watch and wristband is provided by an injection molding defining a central watch casing and auxiliary casings on either side of the central casing, the molding having opposite ends extending outwardly from the auxiliary casings encircling around towards each other to terminate in spaced relationship to define a wristband integral with the watch casing. An integral metallic stamping of similar exterior contour overlies the injection molding and is provided with central and auxiliary openings in registration with the central casing and auxiliary casings respectively. The metallic strip includes integrally formed spring contacts extending oppositely from diametrical peripheral portions of the central portion of the strip to overlie the auxiliary casings and provide electrical connections for batteries in the casings. The assembly is sonic welded together and one extending end of the metallic stamping serves as a substitute for a normal link in the clasp structure.

5 Claims, 4 Drawing Figures

WRISTWATCH CASING AND BAND CONSTRUCTION

This invention relates generally to wristwatches and more particularly to a casing and band construction for electrically powered wristwatches of the digital read-out type to provide a combined watch and wristband as an essentially integral unit.

BACKGROUND OF THE INVENTION

Electrical wristwatches of the digital read-out type are well known and have become extremely popular in recent years. Generally, these devices include a quartz crystal caused to oscillate at an extremely high frequency which is divided down into accurate time intervals which in turn are utilized in energizing a light emitting diode display or liquid crystal type display. Such watches are still relatively expensive. The reason for the high cost initially was a result of the particular electronics involved. However, with the introduction of integrated circuits and the like, the electronic components of the watch have become relatively inexpensive to provide. Nevertheless, high prices still prevail, primarily as a result of the expense in manufacturing the casing for the module and batteries, the actuating switch button controls, and wristband construction if the band is sold with the watch.

In view of the foregoing, the only practical means to reduce the overall price of these types of wristwatches is to provide innovative means for reducing the cost of materials used in the casing and band constructions as well as improved manufacturing processes in the assembly of the casing and wristband portions.

In addition to the foregoing, watches of the type under consideration require one or more batteries and normally these batteries are incorporated in the same casing portion as the module for the watch, resulting in a fairly bulky "package". Reduction in the number of batteries or in their size would help solve the problem of "bulkiness" but such solutions decrease the effective useful life of the watch before batteries have to be changed. There is thus room for substantial improvement in the particular casing construction in the direction of avoiding the appearance of "bulkiness" and yet capable of accommodating sufficient battery power to energize the watch for an extended period of time.

BRIEF DESCRIPTION OF THE PRESENT INVENTION

With the foregoing considerations in mind, the present invention concerns a watch casing and band construction which can not only be economically manufactured with materials substantially less expensive than many materials presently incorporated, but is so designed as to accommodate sufficient battery capacity to power the watch for approximately twice as long as is possible with present day watches, all without sacrifice of quality construction and attractiveness of the overall wristwatch.

Briefly, the foregoing is accomplished by providing a combination watch and band construction including an integral plastic injection molding defining a central watch casing and auxiliary casings on either side of the central casing. This molding has opposite ends extending outwardly from the auxiliary casings encircling around towards each other to terminate in spaced relationship to define a wristband integral with the watch casing.

An integral metallic stamping in the form of a strip in turn, has a central opening and auxiliary openings positioned to overlie the injection molding in registration with the central casing and auxiliary casings respectively. This strip has oppositely directed integral spring tongues extending into the auxiliary openings from diametrically opposite peripheral points of the strip portion defining the central opening, the opposite ends of the strip extending outwardly from the auxiliary openings encircling around on the exterior of the molding to terminate in a clasp structure between the spaced ends of the injection molding.

The assembly is completed by the provision of center and auxiliary lens elements individually receivable in the central and auxiliary openings of the strip to define covers for the central and auxiliary casings.

With the foregoing arrangement, a watch module may be carried in the central casing and batteries for energizing the module carried in the auxiliary casings, the referred to spring tongues serving as electrical contacts for the batteries.

BRIEF DESCRIPTION OF THE DRAWINGS

A better understanding of this invention as well as further features and advantages thereof will be had by now referring to the accompanying drawings in which.

DETAILED DESCRIPTION OF THE INVENTION

Figure 1:
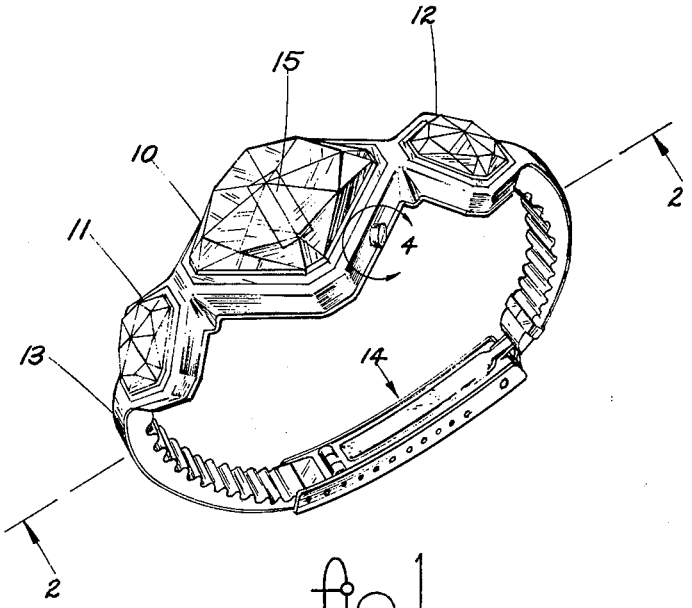
FIG. 1 is a perspective view of a combined watch and wristband in accord with the present invention.

Referring to FIG. 1 the watch includes a central watch casing 10 and auxiliary casings 11 and 12 on either side of the central casing. A wristband 13 is integral with the watch having opposite ends extending outwardly from the auxiliary casings encircling around towards each other to terminate in a clasp structure 14. A digital read-out display of the time is indicated at 15.

Figure 2:
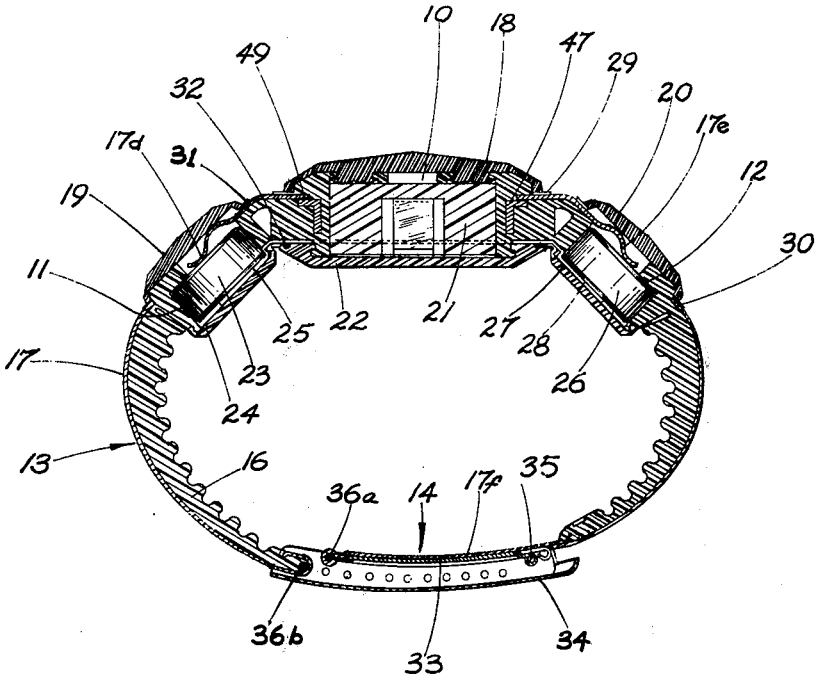
FIG. 2 is an enlarged cross section of the watch and band structure taken in the direction of the arrows 2—2 of FIG. 1.

Referring now to FIG. 2 details of the basic structure described in FIG. 1 will become evident. As shown, the casing structure itself is defined by an integral plastic injection molding 16 defining the central casing 10 and auxiliary casings 11 and 12. The opposite end portions of the integral molding 16 extending outwardly and circling around towards each other to terminate in spaced relationship and define a wristband integral with the watch casing is evident.

Cooperating with the integral plastic injection molding 16 is an integral metallic stamping in the form of a strip 17 having a central opening **17*a* and auxiliary openings 17*b* and 17*c* positioned to overlie the injection molding in registration with the central casing 10 and auxiliary casings 11 and 12 respectively. The strip 17 further includes oppositely directed integral spring tongues 17*d* and 17*e* extending into the auxiliary openings 17*a* and 17*b*** from diametrically opposite peripheral portions of the strip portions defining the central opening. It will further be noted that the opposite ends of the strip extend outwardly from the auxiliary openings to circle around on the exterior of the molding and terminate in the clasp structure 14 between the spaced ends of the injection molding.

Also shown in FIG. 2 are center and auxiliary lens elements 18, 19 and 20 individually receivable respectively in the central and auxiliary openings of the strip 17 to define covers for the central and auxiliary casings.

The foregoing casings are also provided with removable bottom sealing caps forming the floor of the central casing and auxiliary casings in the injected molding, the center casing accommodating the watch module and the auxiliary casings accommodating batteries. Thus, as shown in FIG. 2 there is provided the watch module 21 in the central casing 10 and removable bottom sealing cap 22. The auxiliary casing 11, in turn, incorporates a battery 23 with its associated bottom sealing cap 24. It will be evident that the spring tongue contact 17*d* constituting an integral part of the metallic stamping 13 serves as one contact with the battery, the other battery contact connecting through the sealing cap to the module by way of a conducting insert 25 in the injected molding.

Similarly, the auxiliary casing 12 includes a battery 26 and associated removable sealing cap 27. Again the integral spring tongue contact 17*b* serves as one contact for the battery 26 the other contact being completed through the cap 27 and conducting insert 28 to the module 21.

A trim bezel shown at 29 surrounds the center lens element 18. Similarly, smaller trim bezels are provided for the auxiliary lens elements 19 and 20 as indicated at 30 and 31 respectively. The central casing 10 and removable cap member 22 are hermetically sealed by means of an O-ring 32.

The injection molding 16 and metallic strip 17, in turn, are secured together by sonic welding.

Referring now to the lower portion of FIG. 2, details of the clasp structure 14 will become evident. As shown, one end portion of the metallic stamping 17 is extended as at 17*f* to function as a link member of the clasp. As a consequence, only two auxiliary link members as indicated at 33 and 34 are required to provide a complete clasp with the extended portion of the metallic stamping. As shown, links 33 and 34 are pivoted together at first ends at 35 with their second ends pivoted respectively to the ends of the metallic band as at 36*a* and 36*b*.

Figure 3:
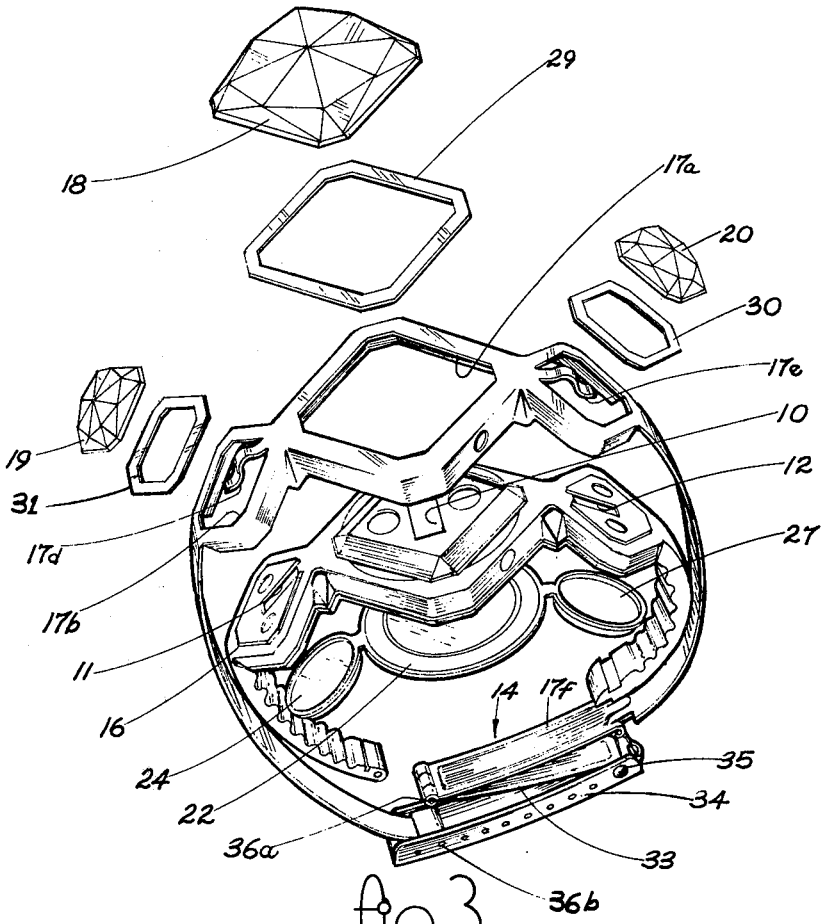
FIG. 3 is an enlarged exploded perspective view of the basic components making up the casing and band construction of the watch of FIG. 1.

All of the foregoing will become clearer by referring to the exploded view of FIG. 3 wherein the casings 10, 11 and 12 formed in the injection molding 16 are clearly shown with the central opening and auxiliary openings 17*a*, 17*b* and 17*c* for the metallic stamping 17 disposed thereabove. The respective lens elements 18, 19 and 20 are also shown exploded above the openings in the metallic stamping.

Also in FIG. 3, the cooperation of the components making up the clasp 14 will be evident, the clasp being shown in partially unlocked position. It will be understood that identical numerals have been used for the corresponding component parts in the exploded view of FIG. 3 as used in describing FIGS. 1 and 2.

Figure 4:
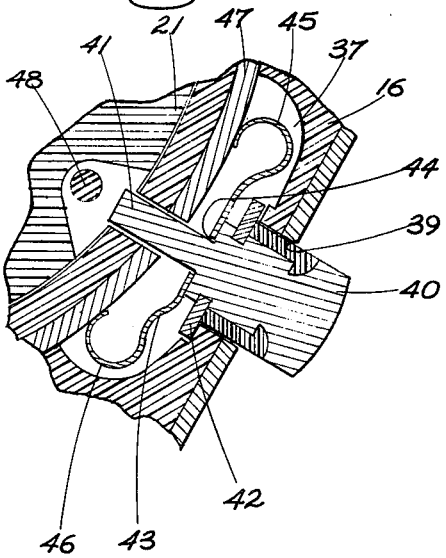
FIG. 4 is a fragmentary view partly in cross section of a portion of the watch casing enclosed within the circular arrow 4 of FIG. 1.

Referring now to FIG. 4, there is shown a further important feature of this invention in the form of an actuating switch button which is normally provided on the sides of watch casings of the digital read-out type in order to render the display visible. Applicant's copending patent application Ser. No. 599,647 filed July 28, 1975 and entitled SIMPLIFIED ACTUATING SWITCH FOR ELECTRONIC TIMEPIECES discloses detailed construction of a preferred type of such switch.

The particular push button switch shown and described in the above-mentioned copending application requires assembly from inside the watch casing, the button portion itself having to be urged outwardly through an opening in the side of the casing. In order to minimize manufacturing and assembly expenses in accord with the present invention, a slight modification is made in the corresponding switch illustrated in FIG. 4. More particularly, the design lends itself to the basic injected molded and metallic stamping concept and further permits assembly of a part of the switch from the exterior of the casing.

Referring now specifically to FIG. 4, the plastic injection molding 16 and metallic stamping 17 are shown in cross section and fragmentary form and it will be noted that the injection molding includes a molded cavity 37 having a side opening 38, the stamping itself having a registering opening 39. An actuating switch button 40 is receivable through the registered openings and terminates in a conducting probe 41 within the cavity. A lock ring 42 is receivable about the inside portion of the button to prevent it from moving out of the registered openings.

A conducting leaf spring strip 43 has a center opening 44 through which the conducting probe 41 extends the opposite ends of the strip shown at 45 and 46 being convexly curled and in wiping engagement up against an annular metallic insert 47.

The leaf spring strip 43 serves a dual function. First, it serves to return the button 40 after it has been depressed and second, it completes an electrical connection from the end of the probe to the insert, the end of the probe engaging a module contact 48 on the module 21 when depressed inwardly.

The lock ring is inserted on the button after the button has been passed through the registered openings from the exterior of the stamping so that assembly of the switch can be accomplished partly from the exterior.

Since the cavity and appropriate opening in the injected molded plastic can be formed at the time of the injection molding, there is substantially no increase in expense in providing for the push button switch. Similarly, the opening in the metallic stamping is formed at the time of the stamping and the assembly of the parts by provision of the lock ring is greatly simplified.

The metallic insert ring 47 of FIG. 4 is also shown in FIG. 2 and designated by the same numeral. This insert electrically connects to the metallic stamping as indicated at 49 in FIG. 1 and thus depression of the button electrically connects the module contact 48 with the stamping and spring tongue contacts 17*d* and 17*e*.

It will be understood that the watch casing will include further buttons for effecting various electrical operations in the watch which may be similarly constructed, only the one enclosed within the circular arrow 4 of FIG. 1 being described in detail.

From the foregoing description, it will be evident that the present invention has provided a greatly improved wristwatch and band construction which vastly reduces the manufacturing expense without sacrifice of quality or appearance. The provision of the auxiliary casings on either side of the main casing for accommodating batteries permits more batteries to be utilized than in conventional type watches with the result that the watch can run continuously for almost twice as long as normal watches; for example, 2 years. Moreover, by positioning the batteries on either side of the main casing, the overall bulkiness insofar as height or depth of the watch structure is concerned can be reduced.

Hermetic sealing by the bottom removable caps particularly at the central casing by means of the O-ring is assured. The metallic stamping itself is unique in that the integral spring tongues can be formed as a part of the stamping for providing electrical connections to the battery. In addition, the stamping, as described, includes an extended end which replaces one of the links in the normal clasp construction thereby again simplifying the construction and reducing expenses.

It will accordingly be appreciated that the present invention has provided a true combination watch and wristband which can not only be manufactured for substantially less expense as described but is attractive in overall appearance as well.

What is claimed is:

1. A wristwatch casing and band construction comprising, in combination:

a. an integral plastic injection molding defining a central watch casing and auxiliary casings on either side of the central casing, said molding having opposite ends extending outwardly from the auxiliary casings and circling around towards each other to terminate in spaced relationship to define a wristband integral with the watch casing;

b. an integral metallic stamping in the form of a strip having a central opening and auxiliary openings positioned to overlie said injection molding in registration with said central casing and auxiliary casings respectively, said strip further including oppositely directed integral spring tongues extending into the auxiliary openings from diametrically opposite peripheral portions of the strip defining the central opening, the opposite ends of said strip extending outwardly from said auxiliary openings and circling around on the exterior of said molding to terminate in a clasp structure between the spaced ends of said injection molding; and, c. center and auxiliary lens elements individually receivable respectively in the central and auxiliary openings of said strip to define covers for the central and auxiliary casings, whereby a watch module may be carried in said central casing and batteries for energizing said module carried in said auxiliary casings to provide a combined watch and band said spring tongues serving as electrical contacts for said batteries.

2. A construction according to claim 1, including removable bottom sealing caps forming the floor of the central casing and auxiliary casings in said injection molding to provide access to the interior of the casings; and an O-ring for sealing the cap covering the central casing to hermetically seal a watch module in said central casing.

3. A construction according to claim 1, in which said central casing of said injection molding includes a cavity having a side opening, said stamping having a registering opening; an actuating switch button receivable through the registered openings and terminating in a conducting probe within said cavity; a lock ring receivable about the inside portion of said button to prevent it from moving out of said registered openings; a conducting leaf spring strip having a center opening through which said conducting probe extends, the opposite ends of the strip being curled to define convex surfaces; and an annular metallic insert in wiping engagement with said convex surfaces and electrically connected to said metallic stamping, said spring serving the dual function of returning said button after it has been depressed and completing an electrical connection from said probe to said stamping, the end of said probe engaging a module contact on a module in said central casing when depressed inwardly, said lock ring being inserted on said button after it has been passed through the registered openings from the exterior of the stamping so that assembly of the switch can be accomplished partly from the exterior of the central casing.

4. A construction according to claim 1, in which said injection molding and integral metallic stamping are held together by sonic welding.

5. A construction according to claim 2, in which one end portion of said metallic stamping is extended to function as a link of said clasp, whereby only two auxiliary link members are required to provide a complete clasp with the extended portion of said metallic stamping.

* * * * *